United States Patent [19]

Hubbard

[11] Patent Number: 4,949,738

[45] Date of Patent: Aug. 21, 1990

[54] SMALL PARTS CATCHER FOR HIGH PRESSURE FLUID CLEANING APPARATUS

[75] Inventor: William F. Hubbard, Gambrils, Md.

[73] Assignee: David W. Wootton, Lutherville, Md.

[21] Appl. No.: 387,795

[22] Filed: Aug. 1, 1989

[51] Int. Cl.[5] ..... B08B 3/02

[52] U.S. Cl. ..... 134/104.3; 34/202; 134/198

[58] Field of Search ..... 134/104.3, 117, 154, 134/182, 183, 198, 200; 34/85, 202, 243 R; 422/26, 28, 292, 300; 15/34.5, 405

[56] References Cited

U.S. PATENT DOCUMENTS

| | | | |
|---|---|---|---|
| 1,037,073 | 8/1912 | Sonnemann | 134/200 |
| 1,566,860 | 12/1925 | Hainzigianis | 422/300 X |
| 2,601,364 | 6/1952 | Byrnes | 134/151 |
| 2,704,082 | 3/1955 | Jackson | 134/200 X |
| 4,718,440 | 1/1988 | Hawker et al. | 134/200 X |
| 4,782,843 | 11/1988 | Lapaglia | 134/200 X |
| 4,838,949 | 6/1989 | Dugrot | 134/182 X |

OTHER PUBLICATIONS

Metreaud, C. G., "Article Cleaning Apparatus", IBM Technical Disclosure Bulletin, vol. 9, No. 12, May 1967, p. 1740.

*Primary Examiner*—Philip R. Coe
*Attorney, Agent, or Firm*—N. J. Aquilino

[57] ABSTRACT

An attachment for a high pressure fluid cleaning outlet for confining small items subjected to the fluid stream including an elongated housing having a body with an opening therein, an upper cover with an integrally mounted outlet nozzle for attachment to a source of high pressure fluids and a lower cover including a screen member which permits the cleaning fluid to pass through, but which catches and confines solid items which may become dislodged during the cleaning process.

6 Claims, 1 Drawing Sheet

SMALL PARTS CATCHER FOR HIGH PRESSURE FLUID CLEANING APPARATUS

BACKGROUND OF THE INVENTION

The present invention is directed to an attachment for a high pressure fluid cleaning apparatus, and in particular for a catcher device to confine small parts during a high pressure cleaning process.

Small parts or items, for example, gems, jewelry pieces, watch parts and the like, often are cleaned using high pressure fluid such as steam or other liquid, the item to be cleaned is conventionally held within the fluid cleansing stream adjacent the high pressure cleaning nozzle either by hand or using a tool. During this process the force of the cleaning fluid often dislodges the item being cleaned from the holder resulting in the part being lost, or damaged. Thereby causing costly delays in the work process.

An example of a holding and spraying device for cleaning small parts in a fluid flow stream is shown in the patent to Burns (2,601,364). The device includes a hose coupling, a housing adapted to hold a plurality of small parts, and a screen adjacent the outlet which permits continuous fluid flow through the device.

The present invention is directed to a catcher attachment for use with a high pressure fluid cleaning apparatus. It is particularly suitable for catching small items which may become dislodged or dropped during a steam cleaning process. The apparatus is formed of a generally elongated transparent housing having an upper and lower cover. The upper cover includes a fitment and nozzle suitable for attachment to a high pressure source of cleaning fluid such as steam. The lower cover is open to fluid flow and includes a screen covering which catches and confines small parts which become free during the cleaning process.

DESCRIPTION OF PREFERRED EMBODIMENTS

Figure 1:
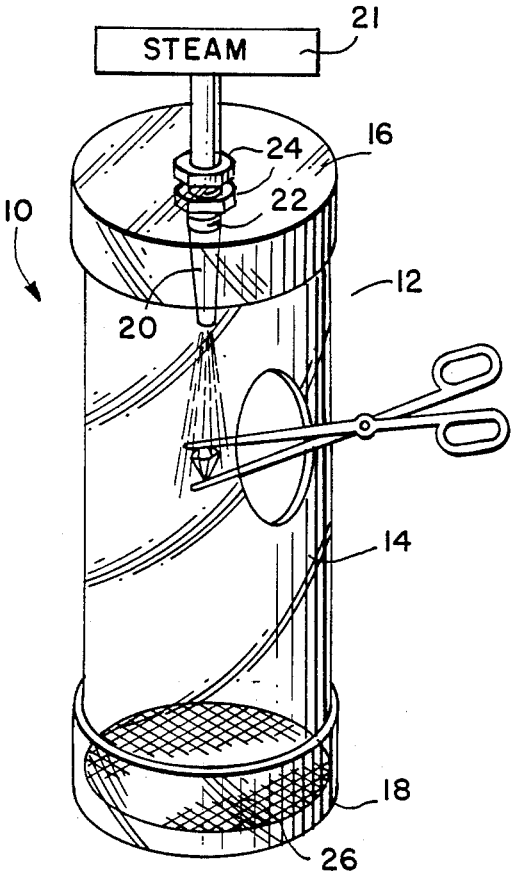
FIG. 1 is a pictorial view of the attachment of the present invention.
Figure 2:
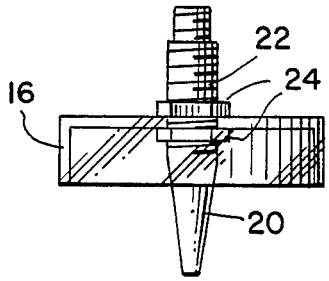
FIG. 2 is a side elevational view of the top cover of the attachment of FIG. 1.
Figure 3:
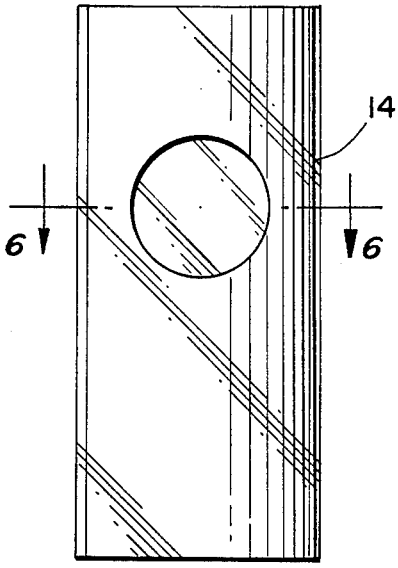
FIG. 3 is a side elevational view of the body of the attachment of FIG. 1.
Figure 4:
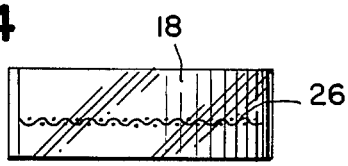
FIG. 4 is a side elevational view of the end cover of the attachment of FIG. 1.
Figure 5:
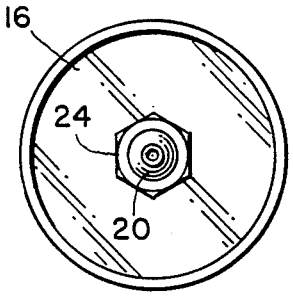
FIG. 5 is an end elevational view of FIG. 2.
Figure 6:
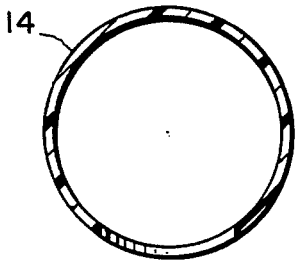
FIG. 6 is an end sectional view taken along the lines 6—6 of FIG. 3.
Figure 7:
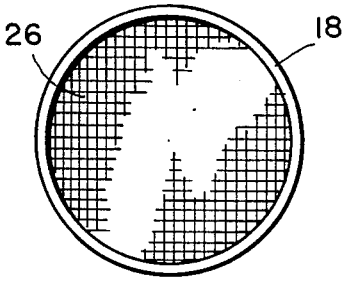
FIG. 7 is an end elevational view of FIG. 4.

Referring to the drawings, the attachment 10 for catching and confining small items subjected to a high pressure cleaning fluid outlet is shown in the drawings formed of a generally elongated cylindrical housing 12 having a body portion 14 an upper end cover 16 and lower end cover 18. The housing 12 is preferrably formed of clear transparent plastic material which would provide an appropriate view to a user during a cleaning operation. The upper end cover 16 includes an integrally mounted outlet nozzle 20 which is structured to be attached to a source 21 high pressure cleaning fluid such as steam or similar liquid and/or gas. The nozzle 20 includes threads 22 which permit attachment to the high pressure fluid source and is preferably centrally located on the upper end cover 16 by suitable mounting nuts 24 which position the nozzle 20 generally co-axial with the longitudinal axis of the housing 12. It will be appreciated that the nozzle 20 need not be limited to the specific shape or to the mounting position shown in the drawings.

The upper end cover 16 telescopically fits onto the housing body 14. Suitable fasteners such a screws or bolts (not shown) may be used to secure the upper end cover 16 in place on the body portion 14 of the housing 12.

The lower end cover 18 is open at its bottom and telescopically fits over the housing body 14. The bottom opening is covered by a screen 26 which is integrally attached adjacent the lower peripheral rim of the lower end cover 18. The opening permits the cleaning fluid to pass out of the housing 12 into the atmosphere or a suitable catch basin (not shown). The screen 26 catches and confines any items which may become dislodged during the cleaning process.

For example, when the high speed outlet nozzle 20 is actuated to emit a high pressure cleaning fluid, a user would hold an item to be cleaned with a tool and insert it within the opening formed in the body 14 of the housing 12 as shown in FIG. 1. Since the housing is transparent, the user can easily position the article to be cleaned in the fluid flow stream. If the article to be cleaned, or a portion thereof, becomes dislodged from the workholder, it will fall either by the gravity or by the force of the entraining cleaning fluid to the bottom of the housing where it would be caught by the screen and maintained in this confined position so as not to become lost.

It will be appreciated that changes or modifications may be made to the attachment described above. For example, the housing need not be cylindrical, and it may be made of other materials. The upper and lower covers may also be of a variety of shapes while remaining within the spirit and scope of the present invention as defined in the following claims.

I claim:

1. An attachment to a source of high pressure cleaning fluid for confining items which may be dislodged by a fluid stream of said high pressure cleaning fluid during a cleaning process comprising;

a housing having an upper end, an elongated central body and a lower end;

said upper end including a nozzle means integrally connected thereto, said nozzle means having means for attachment to said source of high pressure cleaning fluid on one end thereof and a fluid outlet on the other end thereof for directing fluid in a direction along the longitudinal axis of said housing;

said central body section having a permanent opening formed adjacent said fluid outlet of said nozzle, said opening being sized to permit access to said fluid stream of said high pressure fluid from the outside of the housing during the cleaning process while preventing the escape of and maintaining said fluid stream and any dislodged items within said housing during the cleaning process;

said lower end including a fluid passage opening, and a screen member covering said fluid passage opening and structured to catch and confine any items dislodged by said fluid stream preventing them from passing out of said housing while simultaneously permitting the passage of said fluid stream through said screen and out of said housing.

2. The attachment of claim 1 wherein said housing is cylindrical in shape.

3. The attachment of claim 2 wherein said cylindrical housing is made of transparent material.

4. The attachment of claim 3 wherein said transparent material is plastic.

5. The attachment of claim 1 wherein said lower end comprises a removable cover, attached to said elongated central body section.

6. The attachment of claim 1 wherein said upper end comprises a removable cover, attached to said elongated central body section.

* * * * *